US006279922B1

(12) United States Patent
Gaster

(10) Patent No.: US 6,279,922 B1
(45) Date of Patent: Aug. 28, 2001

(54) IN-LINE SKATE WHEEL DISABLING APPARATUS

(76) Inventor: Richard S. Gaster, 2702 Motor Ave., Los Angeles, CA (US) 90064

( * ) Notice: Subject to any disclaimer, the term of this patent is extended or adjusted under 35 U.S.C. 154(b) by 0 days.

(21) Appl. No.: 09/325,371

(22) Filed: Jun. 4, 1999

(51) Int. Cl.[7] ..... A63C 17/02

(52) U.S. Cl. ..... 280/11.221

(58) Field of Search ..... 280/7.11, 7.19, 280/11.2, 11.204, 11.207, 11.211, 11.214, 11.215, 11.221; 188/21, 19, 24.21, 29.12, 71.1

(56) References Cited

U.S. PATENT DOCUMENTS

| | | | | |
|---|---|---|---|---|
| 199,664 | | 1/1878 | Robinson . | |
| 988,533 | | 4/1911 | Zverina . | |
| 2,035,897 | | 3/1936 | Kosanovich . | |
| 2,148,687 | | 2/1939 | English . | |
| 2,581,809 | | 1/1952 | Murray . | |
| 3,351,353 | | 11/1967 | Weitzner . | |
| 3,387,852 | | 6/1968 | De Sarro . | |
| 3,979,842 | | 9/1976 | Texidor . | |
| 4,114,295 | | 9/1978 | Schaefer . | |
| 4,273,345 | | 6/1981 | Ben-Dor . | |
| 4,333,249 | | 6/1982 | Schaefer . | |
| 4,526,389 | | 7/1985 | Chase . | |
| 4,869,351 | * | 9/1989 | Romano | 188/24.21 |
| 4,988,122 | | 1/1991 | Saunders . | |
| 5,183,292 | | 2/1993 | Ragin, III . | |
| 5,224,718 | | 7/1993 | Gertler . | |
| 5,232,231 | * | 8/1993 | Carlsmith | 280/11.2 |
| 5,239,941 | | 8/1993 | Chibi . | |
| 5,293,965 | * | 3/1994 | Nagano | 188/24.21 |
| 5,303,955 | | 4/1994 | Zurnamer . | |
| 5,320,367 | | 6/1994 | Landis . | |
| 5,340,131 | * | 8/1994 | Smathers et al. | 280/11.204 |
| 5,388,844 | | 2/1995 | Pellegrini, Jr. . | |
| 5,398,970 | | 3/1995 | Tucky . | |
| 5,400,484 | | 3/1995 | Gay . | |
| 5,445,415 | | 8/1995 | Campbell . | |
| 5,464,235 | * | 11/1995 | Goldman et al. | 280/11.2 |
| 5,503,433 | | 4/1996 | Lachapelle . | |
| 5,505,469 | * | 4/1996 | Zori et al. | 280/11.204 |
| 5,522,621 | | 6/1996 | Schneider . | |
| 5,551,711 | | 9/1996 | Mangelsdorf . | |
| 5,573,275 | | 11/1996 | Smith . | |
| 5,580,094 | | 12/1996 | Ruehlman . | |
| 5,586,777 | | 12/1996 | Wolf . | |
| 5,664,794 | | 9/1997 | Mitchell . | |
| 5,697,643 | | 12/1997 | Marasco . | |
| 5,727,796 | | 3/1998 | Zhang . | |
| 5,765,841 | | 6/1998 | Johnson . | |
| 5,765,870 | | 6/1998 | Riley . | |
| 5,772,220 | | 6/1998 | Gaster . | |

(List continued on next page.)

FOREIGN PATENT DOCUMENTS

| | | |
|---|---|---|
| 0 063 104 | 10/1982 | (EP) . |
| 0 183 055 | 6/1986 | (EP) . |
| 2 160 780 A | 1/1986 | (GB) . |

*Primary Examiner*—Lanna Mai
*Assistant Examiner*—Toan To
(74) *Attorney, Agent, or Firm*—Henricks, Slavin & Holmes LLP

(57) ABSTRACT

A device for disabling or otherwise allowing the wearer of an in-line skate to walk on the in-line skate without activating the wheels may include a clamping member to clamp the wheels. A switch may be activated which in turn activates or deactivates the clamping member. A walking member may also be provided, the walking member being coupled to the skate and moveable between first and second positions. In the first position the walking member may be secured such that the wearer may walk on the walking member. In the second position, the walking member is positioned such that it will not interfere when skating.

21 Claims, 6 Drawing Sheets

U.S. PATENT DOCUMENTS

| | | |
|---|---|---|
| 5,779,245 | 7/1998 | Smith . |
| 5,785,327 | 7/1998 | Gallant . |
| 5,791,662 | 8/1998 | Searby . |
| 5,797,609 | 8/1998 | Fichepain . |
| 5,803,469 | 9/1998 | Yoham . |
| 5,820,138 | 10/1998 | Hajat Dost Sani . |
| 5,833,270 | 11/1998 | Hubshman . |
| 5,848,808 | 12/1998 | Fenton . |
| 5,855,381 | 1/1999 | Kirk . |
| 5,882,018 | 3/1999 | Petrosino . |
| 5,887,989 | 3/1999 | Petrosino . |
| 5,890,722 | 4/1999 | Smith . |
| 5,906,380 | 4/1999 | Searby . |
| 5,934,693 | 8/1999 | Nicoletti . |
| 5,951,049 | 9/1999 | Calverley . |
| 6,079,747 | 6/2000 | Winsor . |

* cited by examiner

FIG. 4
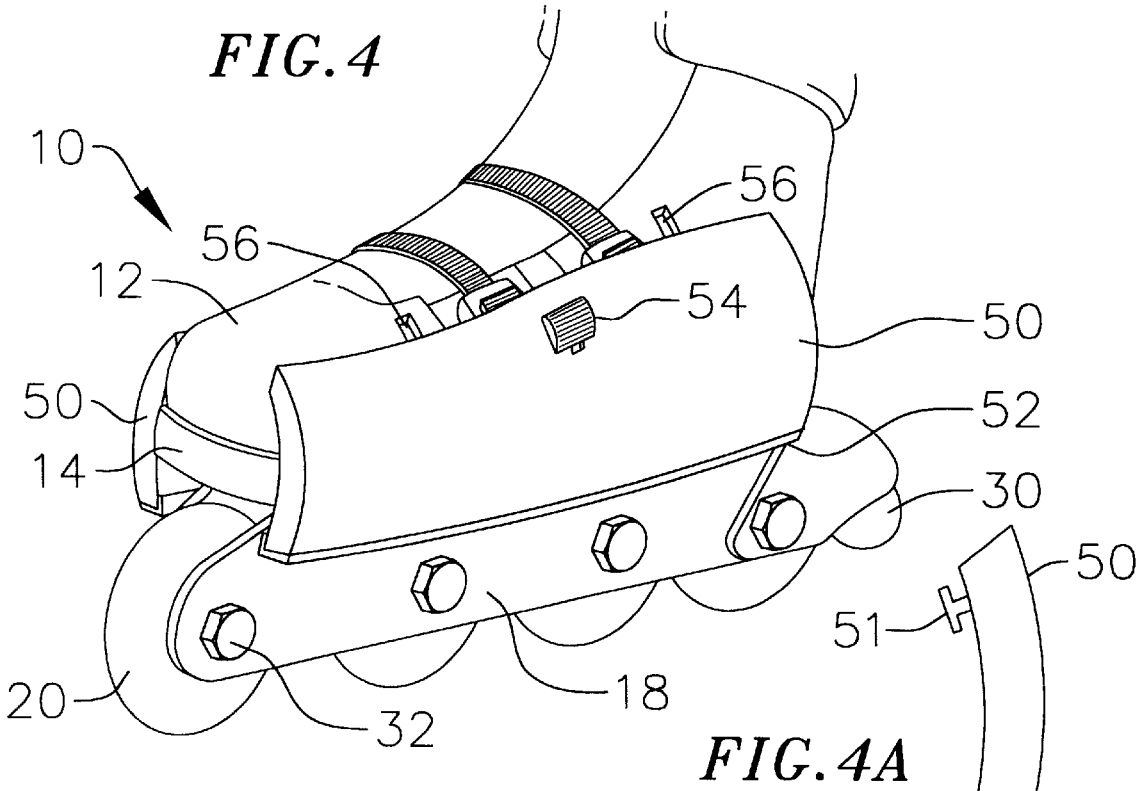
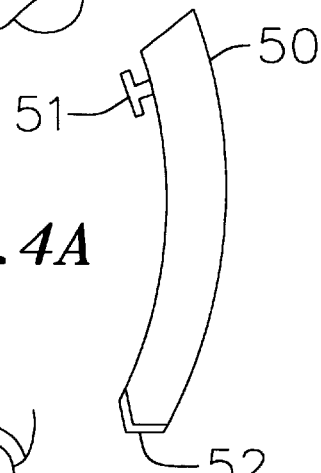
FIG. 4A
FIG. 5
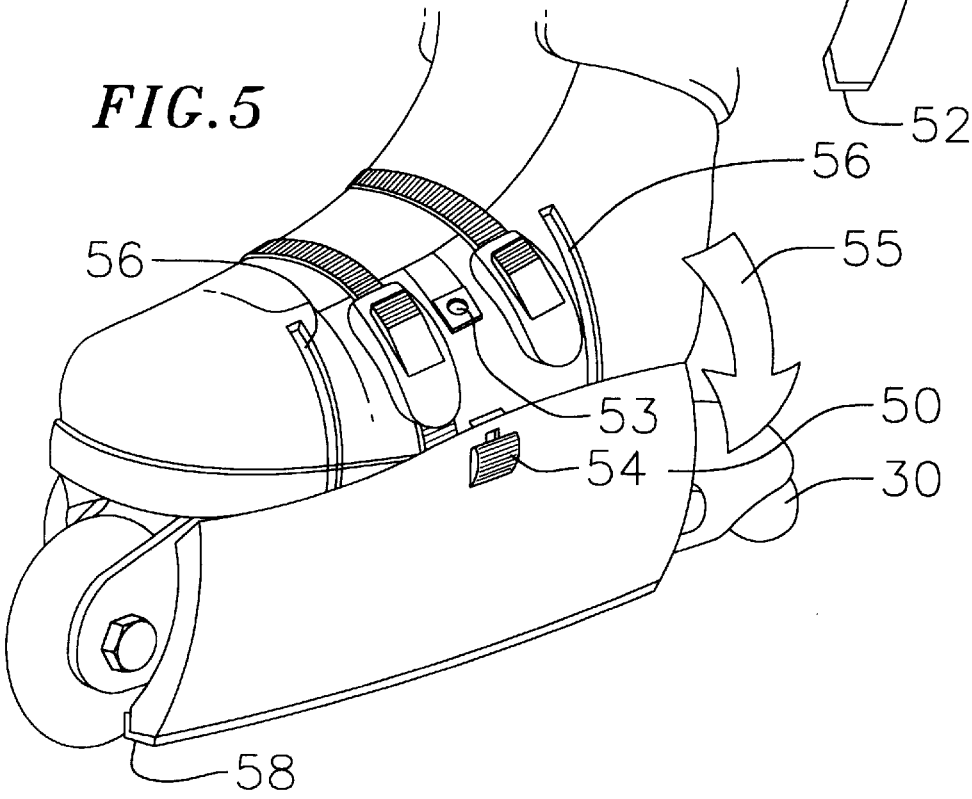

IN-LINE SKATE WHEEL DISABLING APPARATUS

RELATED APPLICATIONS

The present application is related to previously filed U.S. patent application Ser. No. 08/480,011, filed Jun. 7, 1995, now U.S. Pat. No. 5,772,220, and U.S. patent application Ser. No. 09/106,979, filed Jun. 29, 1998. The prior applications are incorporated herein by reference in their entirety.

FIELD OF THE INVENTION

The present invention is directed to an in-line skate conversion apparatus. More particularly, the present invention is directed to an apparatus that enables the wearer of the in-line skate to disable the wheels in order to be able walk in the skate while preventing the wheels of the skate from rolling.

BACKGROUND OF THE INVENTION

Over the last two decades, in-line skating has exploded in popularity. Indeed, in-line skates have replaced roller skates in popularity. One of the reasons for the surge in popularity of in-line skating may be due to the wide variety of equipment available and the lack of a requirement that in-line skating be performed in any particular place. That is, unlike ice skating which requires an individual to go to an ice rink, or roller skating which has traditionally been enjoyed in roller skating rinks, inline skates are specifically manufactured for use on city streets, or virtually anywhere there is a suitable hard surface to skate on. Furthermore, due to the relatively low cost of beginning participation in the sport (which typically requires the purchase of the skates and optional padding for elbows, knees and wrists), in-line skating is economically feasible for most people. As in-line skating has gained in popularity, several problems have arisen.

In particular, novice in-line skaters often have difficulty maintaining their balance while wearing their skates due to the tendency of the skates to roll out from under their bodies. This can create problems for the novice skater since the wearer is still required to maneuver on the in-line skates after stopping. In order to move in any direction, the wearer of the skates must roll to the next location. One example of the problem this poses for novice skaters is the simple act of stopping for lunch at one of the many snack bars along the beach between Venice and Santa Monica in California. After ordering refreshments from a self-service window, the skater must carry the refreshments from the window to a nearby table. This can represent a terrifying journey for a novice in-line skater. A simple visit to any popular in-line skating location will reveal a number of novice in-line skaters attempting to stabilize themselves and/or seeking to prevent themselves from failing while stopped.

In addition, the boom in popularity of in-line skating has resulted in a number of people using their skates to commute or otherwise travel about on a daily basis. However, a number of establishments (e.g. grocery stores, department stores, etc.) expressly prohibit people from skating in their stores. The inventor has found a need for an apparatus to enable the wearer of in-line skates to walk while wearing the in-line skates without activating the wheels. Furthermore, such a device would have to be cost effective, rugged and simple to use while not requiring the wearer to take the skates off their feet. Furthermore, such a device must be usable with a wide variety of in-line skates, including in-line skates having 3, 4 or more wheels. The device must be aerodynamically acceptable to advanced in-line skaters as well as practical for novices to utilize.

Mechanisms for assisting with braking in in-line skates have been known. For example, U.S. Pat. No. 5,320,367 to Landis which issued on Jun. 14, 1994, disclosed a braking apparatus which utilizes a hand-held brake control for causing the application of rubber brake pads to the wheels of the in-line skate to slow the wearer down. In addition, major in-line skate manufacturers have proposed alternative braking mechanisms to assist the wearer in the braking operation.

In addition to the above-described '367 patent, U.S. Pat. No. 4,273,345 to Ben-Dor et al. provides a friction plate for the wearer of the skate to drag along the ground to stop the movement of the skate. U.S. Pat. No. 3,351,353 to D. M. Weitzner discloses a pair of retractable roller and ice skates for shoes. As seen in FIGS. 10 and 13 of the '353 patent, the shoe can be taken apart so that a plate 50 is removed from its channel, inverted, and then reinserted into the channel 40 above the roller assemblies. The plate is thus stored out of the way in the channel and at the same time serves as a spacer and bearing member holding the roller assembly 70 in a stable position in the sole of the shoe, thus enabling the shoe to serve as a roller skate. While the device enables a shoe to be worn as a roller skate, it requires the shoe to be disassembled and reassembled prior to wearing the roller portion of the shoe.

Similarly, U.S. Pat. No. 3,979,842 to Texidor discloses an athletic shoe exerciser that retains rollers when they are not being used in a lower portion of the exerciser. Specifically, as seen in FIG. 2, the roller skates are folded up into the base 14 of the shoe when not in use. Other modifications are sports shoes are also known. For example, U.S. Pat. No. 4,114,295 to Schaefer discloses a convertible sports shoe that may be converted from a roller skate to an ice skate. Similarly, U.S. Pat. No. 3,387,852 discloses roller skates that can be removed from the bottom of the shoe 20. U.S. Pat. No. 5,224,718 to Gertler discloses a foot transport device that can be fastened to a standard walking shoe. Finally, U.S. Pat. No. 4,988,122 discloses a combination roller skate and ice skate that includes a boot which can have a roller portion or an ice skate portion attached thereto.

None of the prior art braking mechanisms address the concerns of the inventor. Namely, to provide a device that allows the wearer of an in-line skate to walk in the skate without activating the wheels and without the need for removing the skate. Such a device is preferably formed as part of the skate such that the wearer is not required to carry any additional equipment or perform any lengthy procedures to convert the skate.

SUMMARY OF THE INVENTION

The present invention provides an apparatus for converting a standard in-line skate to a walking shoe without sacrificing the performance characteristics of the in-line skate. It does so in an efficient manner while providing a easy, simple to use mechanism for both the novice as well as advanced in-line skater.

More particularly, in one embodiment of the present invention, the skater operates a disabling switch to cause friction pads to embrace the wheels, thus preventing the wheels from turning. This allows the skater to walk on the wheels. Since the wheels are prevented from turning, the wheels provide a stable platform for the skater to use while walking.

In another embodiment of the present invention, the upper of the skate supports a pair of arc shaped walking members.

In one position, the walking members are elevated so as to allow the skate to function normally. In another position, each walking member is slid along a pair of channels to a position where the lower edge of each walking member engages the wheels of the skate. In addition, each walking member locks in place, to provide a stable platform in conjunction with the wheels for the skater to walk on.

In a further embodiment of the present invention, a pair of walking members is pivotally mounted to the base of the upper portion of the skate. When skating, the walking members are pivoted upward, and rest adjacent the upper portion of the skate. When walking, the walking members are pivoted downward and form a platform for the skater to walk on. The walking members are locked in place and the wheels are essentially disabled when the walking members are in the downward position.

The above and other embodiments and features of the present invention will be better understood through a reading of the detailed description of the present invention when taken in conjunction with the drawings. It should be understood that the following description and drawings are in no way intended to limit the present invention, which is best defined by the claims appended hereto.

BRIEF DESCRIPTION OF THE DRAWINGS

FIG. 4 is a perspective view of an alternative embodiment of the present invention showing walking members in a raised position.

FIG. 4A is a cutaway side view of the walking member of the embodiment of FIG. 4.

FIG. 5 is a further perspective view of the embodiment of FIG. 4 showing walking members in a lowered position.

DETAILED DESCRIPTION OF THE PREFERRED EMBODIMENTS

Figure 1:
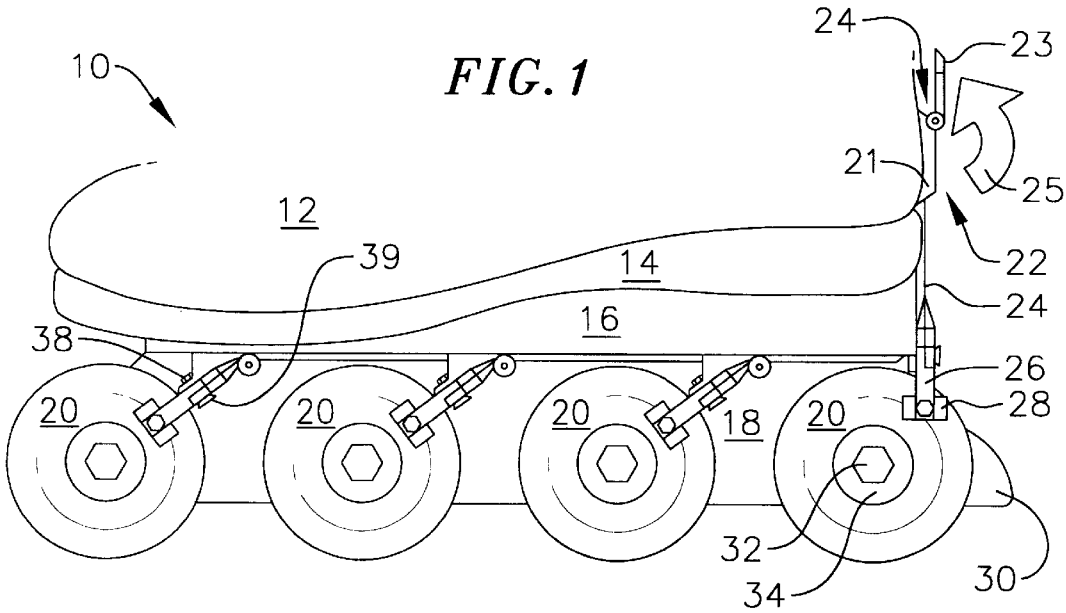
FIG. 1 is a side view of an in-line skate incorporating one embodiment of the present invention.

FIGS. 1–11 illustrate the preferred embodiments of the present invention. In the following discussion of the presently preferred embodiments, like reference numerals refer to like elements. Further, the following discussion is not to be considered in a limiting sense. Rather, while the following discussion taken in conjunction with the drawings illustrate the presently preferred embodiments of the present invention, the invention is in no way limited to the embodiments described below and shown in the drawings. It is to be understood that numerous modifications, additions and/or substitutions can be made to the preferred embodiments without departing from the spirit and scope of the present invention.

Figure 2:
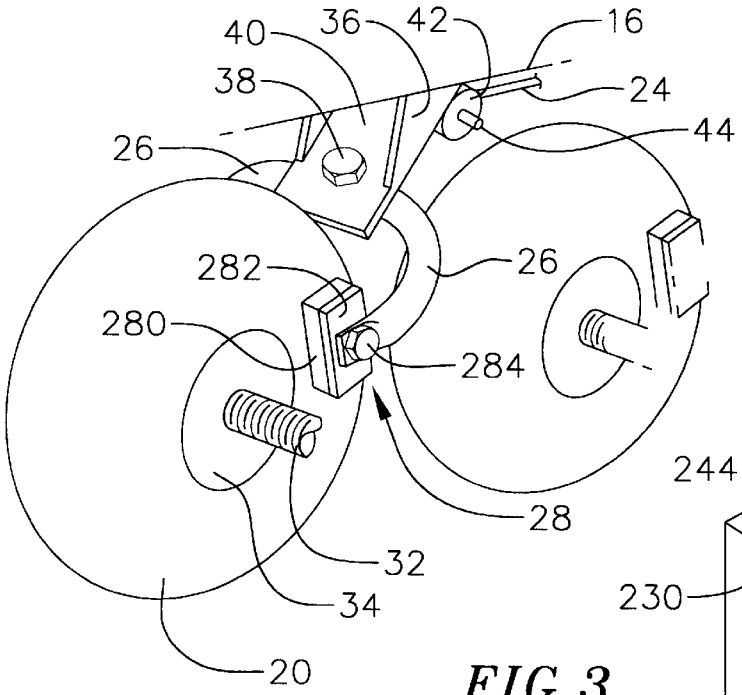
FIG. 2 is a partial detailed perspective view of the in-line skate seen in FIG. 1.
Figure 3:
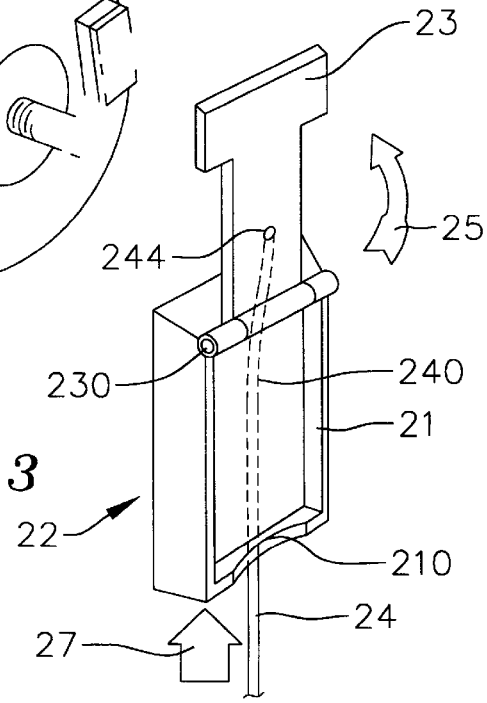
FIG. 3 detailed perspective view of a feature of the embodiment of FIG. 1.

FIGS. 1–3 illustrate a first embodiment of the present invention. As seen therein, an in-line skate 10 can include an upper 12, an outer sole 14 and a wheel attachment member 16. The wheels 20 are supported by a wheel support member 18 that may be attached to the wheel attachment member 16. As seen in FIG. 4, the wheel support member typically is positioned on both sides of the wheels 20, however it is seen on a single side of the wheels 20 in FIG. 1 for purposes of illustrating the wheel disabling mechanism of the present invention.

The wheel disabling mechanism 22 includes a switch support member 21 mounted rearward of the heel of the skate. A switch member 23 is pivotally attached to the switch support member 21 through a hinge mechanism 230. Any suitable hinge mechanism may be utilized with the present invention. Of course, those skilled in the art will readily recognize that it may be possible to utilize other forms of switches with the present invention. For example, a sliding switch member, a turning switch member, or a pulling switch member may also be utilized with out departing from the spirit of the present invention.

The switch member 23 is attached to a cable 24. The cable 24 is preferably formed of steel, although any sufficiently strong material may be utilized. The cable 24 is connected to a series of clamping members 26 which preferably extend downward from the wheel attachment member along both sides of the wheels 20. The clamping members 26, which are essentially braking mechanisms utilized on bicycles and adapted for use on the in-line skate seen in FIG. 1, preferably include a pair of arms for each wheel. Each of the clamping members 26 has frictional pads 28 positioned at the ends thereof to make frictional contact with the wheels 20. The wheels 20, which may be supported on hubs 34 through which pass the axles 32, are typically made of plastic, rubber, polyurethane, or some other suitable material. The length of the clamping members is such that the frictional pads 28 clamp the sides of the wheels 20 at a point that provides a secure frictional contact between the pads 28 and wheels 20. As seen in FIGS. 1 and 2, the contact position between the pads 28 and the wheels 20 may be midway between the hub 34 and the outer diameter edge of the wheel. However, any suitable position on the wheel surface that enables a frictional force sufficient to secure the wheel and preclude the wheel from rotating may be utilized.

As seen in detail in FIG. 2, the pad 28 may be formed of two parts, 280 and 282. The two parts include a resilient frictional pad 280 that contacts the wheel surface and a pad support 282 which may be metal, plastic, nylon, or some other sufficiently strong material to support the pad 280. The two parts, 280 and 282 may be glued together or held together using the bolt 284 used to support the pad 28 at the end of the clamping arm 26. Alternatively, the pad support 282 may be formed internal to the pad 280, or may be eliminated altogether depending the material of the pad 280. The frictional pad 280 may be made of the same material as the wheel 20 or some other material capable of producing a sufficient frictional force when pressed against the wheel 20 to prevent the wheel from rotating.

The clamping members 26 are preferable supported in place above the wheels by a flange 36, through which a bolt 38 passes through the surface 40. A nut 39 may be provided to secure the bolt 38. The flange 36 is sufficiently strong to support the clamping members 26 securely when the clamping members are being used to clamp the wheels 20. The flange 36 may be secured to the wheel attachment member 16 or alternatively may be secured to the upper portion of the wheel support member 18.

As those skilled in the art will appreciate, by utilizing a mechanism substantially identical to a bicycle braking mechanism, the clamping members 26 are spring biased away from the sides of the wheels 20 in normal skating conditions, in the same manner that bicycle brakes are biased away from the wheel of a bicycle when the rider is riding. The cable 24 may be used to overcome the spring bias and force the clamping members 26 in toward the wheels 20, thus causing the wheels 20 to be securely held. As seen in FIG. 2, a roller bearing 42 may be provided on an axle 44 to assist in controlling the position of the cable 24 as it approaches the clamping members 26.

As seen in FIG. 3, the cable 24 passes through the switch support member 21 (as seen by dashed line 240) and connects to the switch member 23 at position 244. In operation, the switch 23 may be rotated on hinge 230 in the direction of arrow 25 during normal skating. This releases tension on cable 24, thus allowing the frictional pads 28 to be spaced from the surface of the wheels 20. To secure the wheels 20, thus enabling the wearer to walk in the skate without the wheels turning, the switch 23 is pivoted in the direction opposite to arrow 25. This introduces tension on the cable 24, causing it to move in the direction of arrow 27. This, in turn, causes the clamping members 26 to move inward, causing contact to be made by between the wheel 20 and the frictional pads 28. The operation is substantially similar to the operation of brakes on a bicycle, however the switch member 23 is held securely in the switch support member 21 to keep tension on the cable 24 and thus keep the frictional pads in contact with the wheels 20. A relief 210 is provided in the switch support member to assist the wearing in removing the switch 23 from the support member 21, thus allowing the frictional pads to be released from contact with the wheels 20.

The position 244 at which the cable 24 connects to switch 23 may be adjusted in order to adjust the amount of tension placed on the cable 24. In addition, while a single cable may be utilized between the switch 23 and the clamping members 26, it is also possible to utilize multiple cables.

Figure 6:
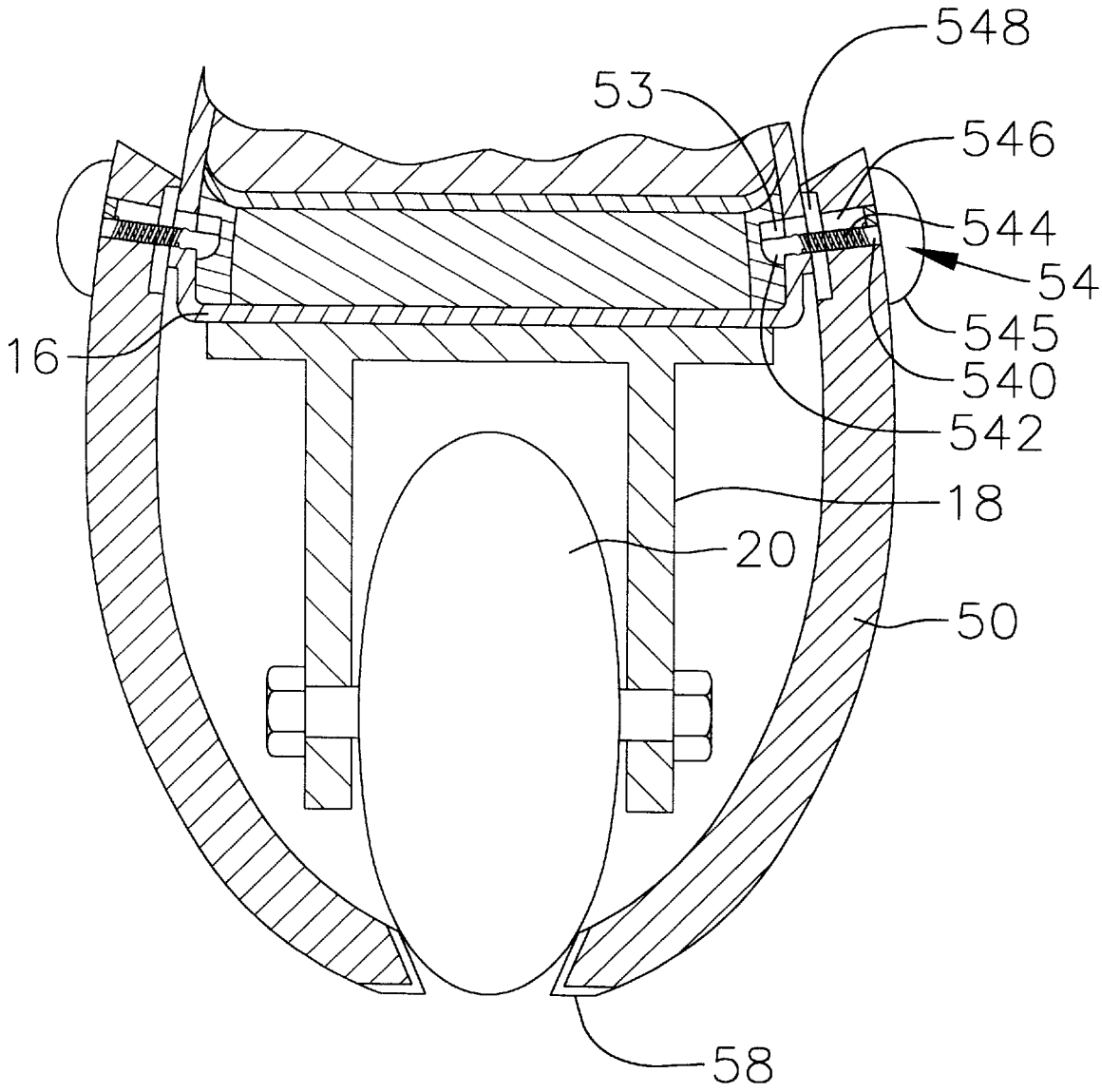
FIG. 6 is a partial rear cross-sectional view of the embodiment of FIG. 4.

FIGS. 4–6 illustrate another embodiment of the present invention. As illustrated herein, the in-line skate 10 is provided with a pair of arc shaped walking members 50, preferably having a resilient portion 52 formed at the lower surface thereof to provide proper friction for walking on the ground as well as for securing the lower edge of the walking members 50 against the side of the wheels 20. In this embodiment, a pair of walking members 50 is provided. It should be understood that both walking members include the features described here.

The walking members 50 are slidably secured to the upper 12 through a pair of channels 56. As seen in FIG. 4A, a pair of T-shaped retaining members 51 protrudes from the inner wall surface of the walking member 50 and is used to prevent the walking members from disengaging from the channels 56. Those skilled in the art will readily appreciate that any suitable retaining member may be utilized, including, but not limited to, screws, bolts, plastic molded plugs or any other suitable member.

A locking member 54 is also provided to secure the walking member in the upper position (seen in FIG. 4) and the lower position seen in FIGS. 5 and 6. The locking member 54 includes a locking arm 540 having a hook-shaped distal end 542. The locking member 54 is biased via spring 544 toward the upper 12 of the in-line skate 10. The button 545 is used to overcome the spring force and remove the distal end 542 of the locking 540 from one of two recesses 53 formed in the upper 12. The recesses 53 include additional space 546 therein to allow the locking member 54 to move upward to disengage the hook-shaped distal end 542 from the recess 53. The locking member is then pulled outward from the recess 53, and a relief 548 is provided to partially accommodate the hook-shaped member.

In operation, when the wearer of the in-line skate 10 wishes to disable the wheels 20, the locking member 54 is pushed slightly upward and then pulled outward to release the locking arm 540 from the recess 53. Once the locking arm is pulled from the recess 53, the walking member 20 is then slid in a downward direction as seen by directional arrow 55. When the walking member reaches the lower position, the locking arm 540 engages the lower recess 53, and the walking member locks in place. The lower recess is positioned such that the resilient portion 58 on the lower edges of the walking member 50 presses against the sides of the wheels 20 so as to prevent the wheels 20 from rotating. Thus, the wheels of the skate are essentially disabled, thus allowing the wearer of the in-line skate to safely walk without fear of the wheels slipping out from under them.

Figure 7:
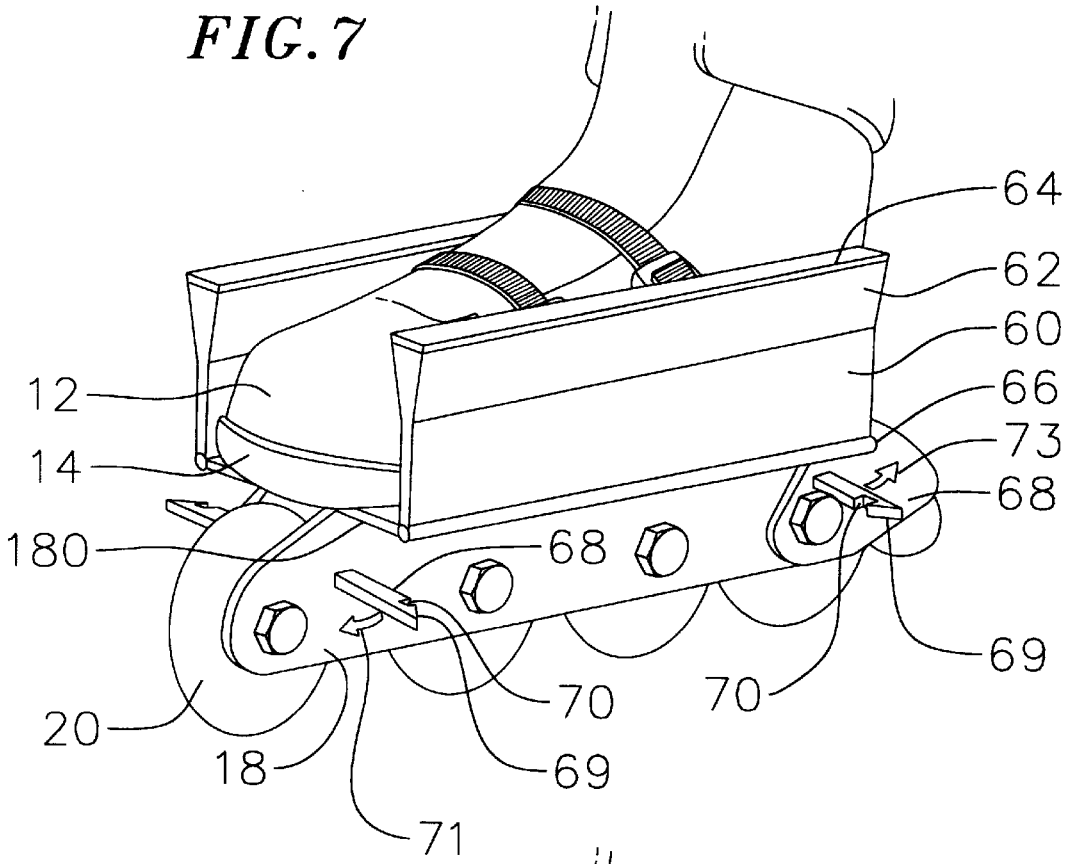
FIG. 7 is a perspective view of a further embodiment of the present invention showing walking members in a raised position.
Figure 8:
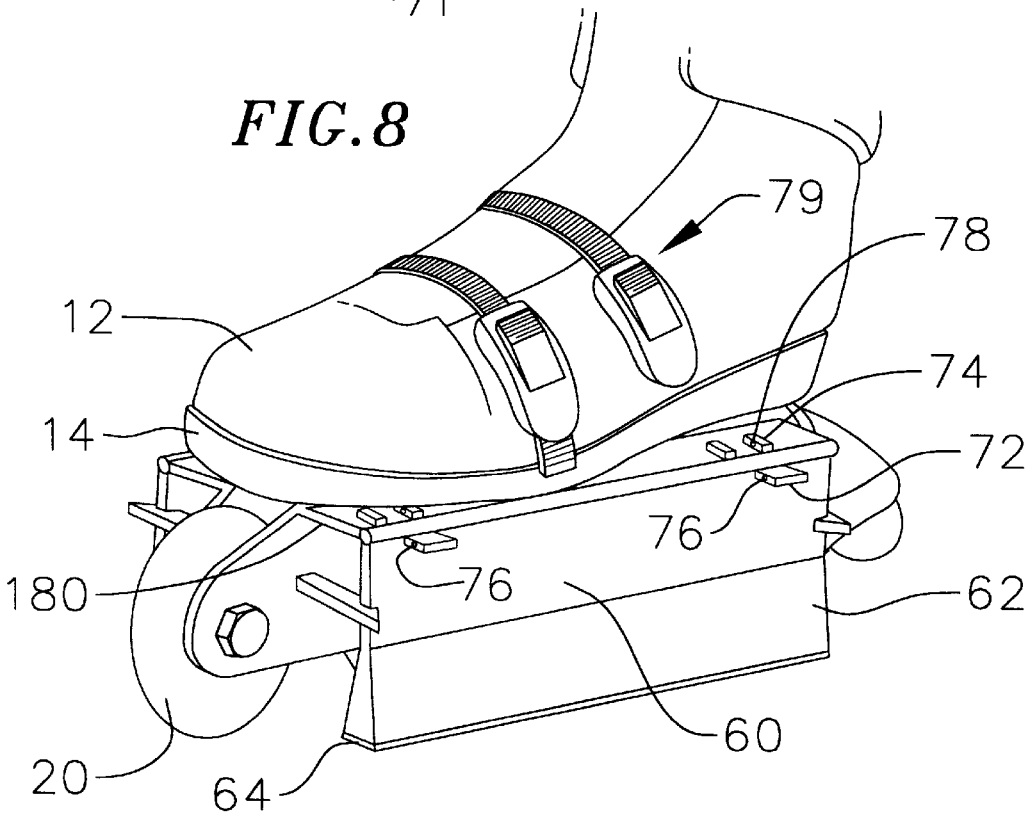
FIG. 8 is a further perspective view of the embodiment of FIG. 7 showing walking members in a lowered position.
Figure 9:
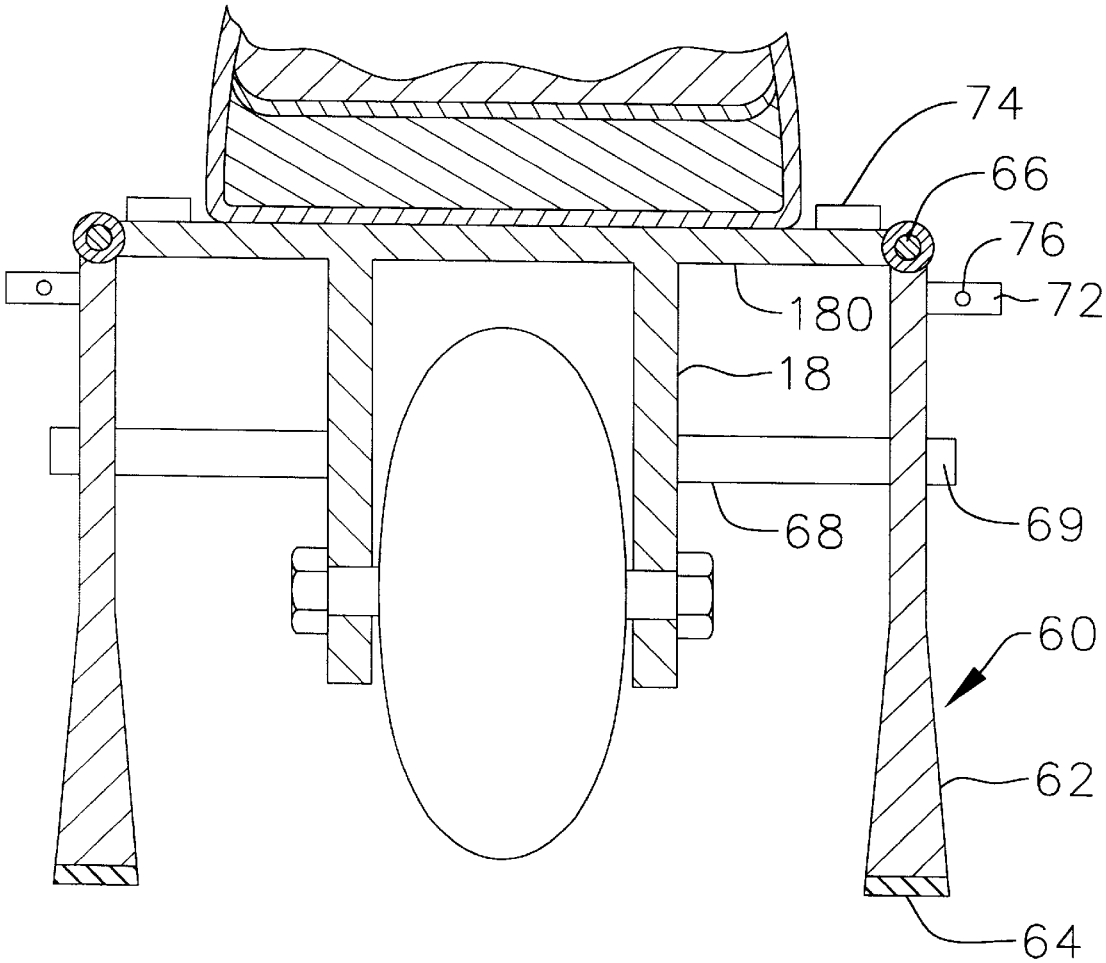
FIG. 9 is a partial rear cross-sectional view of the embodiment of FIG. 7.

A further embodiment of the present invention is seen in FIGS. 7–9. In this embodiment, a pair of walking members 60 are secured by a pair of hinges 66 to the upper surface 180 of the wheel support member 18. The walking members include a flared portion 62 for improved stability when the wearer is walking. A resilient layer 64 is also provided along the edge of the flared portion 62 to provide improved stability when the wearer is walking. The resilient layer may be rubber, polyurethane, ethylene vinyl acetate (EVA), or any other suitable material. A pair of resilient locking tabs 68 is cantilevered from the wheel support member 18 on each side of the in-line skate. The locking tabs are made from a resilient material such as plastic, that affords some spring-like tendencies such that the locking tabs 68 may be movable in direction of directional arrows 71, 73 but tend to spring back to their original position. Each locking tab includes a notch 70 for retaining the walking member 60 therein. In addition, the distal ends 69 of the locking tabs are tapered.

In operation, when the in-line skater wishes to disable or otherwise prevent the wearer simply rotates the walking members about the hinge 66. As the walking members engage the locking tabs 68, the tapered ends 69 cause the locking tabs to spread in the direction of arrows 71, 73. Once the walking members align with the notches 70, the resilient nature of the locking tabs causes the tabs spring back to securely hold the walking members in the notches 70. In this manner, the wearer may then walk on the skate without the wheels touching the ground. Of course, the walking members may be any suitable length, and can be longer or short than that illustrated in FIGS. 7–9. If longer, is possible to form an opening in the walking member to accommodate the locking tabs 68 such that the tabs pass through the opening but then operate in the identical manner to that discussed above.

To return the walking member to the raised position, the wearer simply spreads the tabs 68 with their fingers, thus disengaging the walking members 60 from the notches 70, and rotates the walking members 60 back to the upper position. As seen in FIGS. 8 and 9, a pair of cantilevered fixing blocks 72 extends outward from the walking member 60. The blocks 72 each include a pair of rounded protrusions 76 formed thereon. The blocks 72 are received by receptacles 74 having detents 78 formed therein for receiving the protrusions 76 therein. In this manner, when the walking members 60 reach the raised position, the protrusions secure the walking members in the upright position in the detents 78, thus keeping the walking members 60 in the raised position until lowered by the wearer. Of course, any suitable fixing device may be utilized to secure the walking members in the upright position. For example, it may be possible to utilize bungee cords or some other hook mechanism fixed to the skate hasps 79 or the upper 12 which in turn connect to loops secured to the side of the walking members. Any suitable device that prevents the walking members from falling while the wearer is skating may be utilized.

Figure 10:
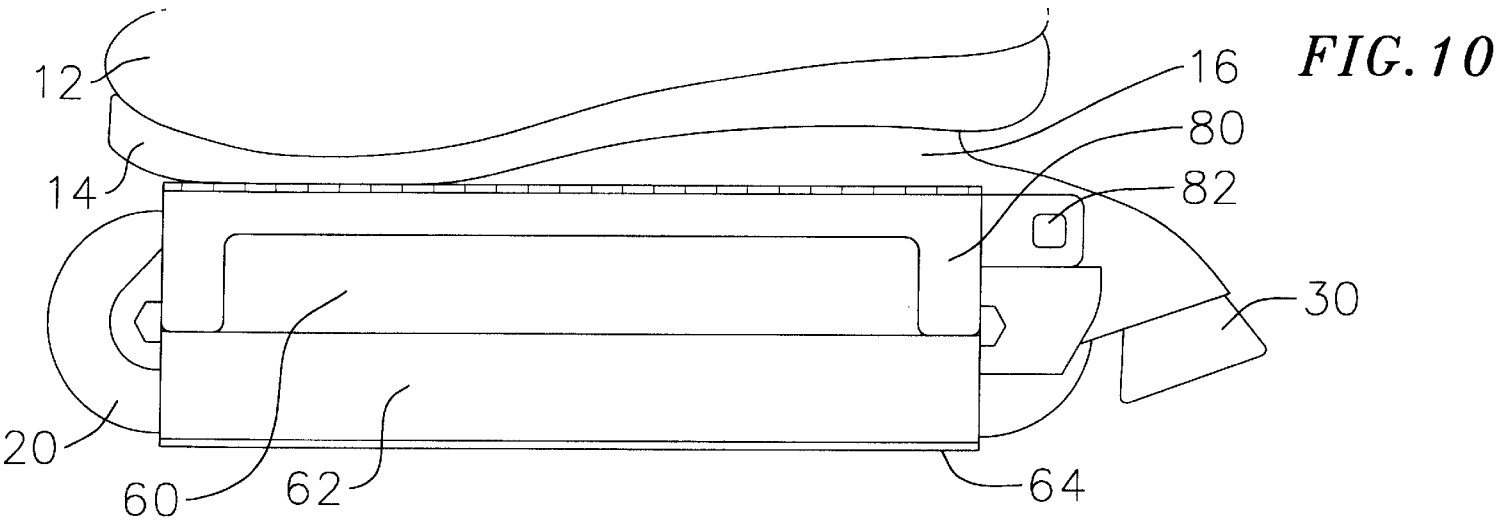
FIG. 10 is a side view of a further embodiment of the present invention showing a walking member in a first position.
Figure 11:
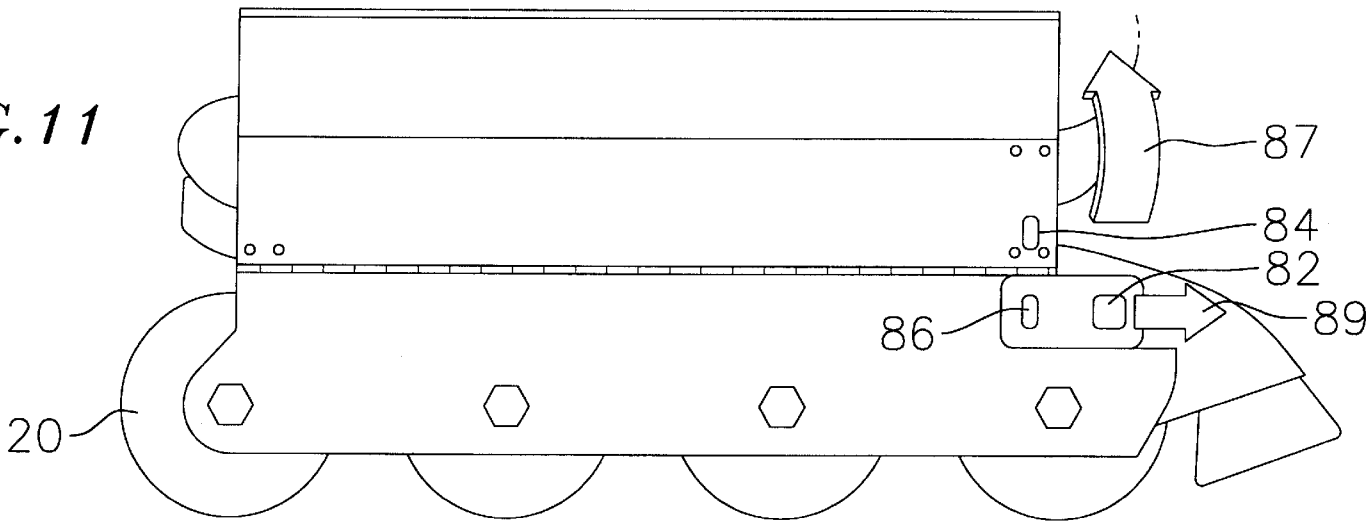
FIG. 11 is a further side view of the embodiment of FIG. 10 showing the walking member in a second position.

For example, a modification to the embodiment of FIGS. 7–9 is seen in FIGS. 10–11. As seen therein, the walking members 60 are provided with a spring hinge member 80 which is biased in the upward direction to hold the walking members 60 up when the wearer is skating. Instead of the locking tabs 68, this embodiment includes a sliding, spring loaded release mechanism 82 that, when operated, releases catch 84 from receptacle 86. The spring loaded, sliding release mechanism 82, together with the catch 84 and receptacle 86 is identical to locking mechanisms commonly found on luggage, brief cases, and other such items.

In operation, the user simply slides the release mechanism 82 in the direction of arrow 89. The spring hinge member 80 then rotates the walking member 60 using the bias force of the spring in the direction of arrow 87. The user simply rotates the walking member 60 back down when seeking to avoid using the wheels 20. The spring loaded release mechanism will cause the catch 84 to be secured in the receptacle 86 until the release mechanism 82 is again operated.

In this embodiment, the flared portions of the walking members 60 can be shaped to press against the sides of the wheels 20. In addition, it may be possible to include more than one release mechanism 82. Further, the spring hinge 80 may be any suitable spring mechanism, or may be replaced with the blocks 72 and receptacles 74 from the previous embodiment.

Of course, those skilled in the art will appreciate that the above-described embodiments of the present invention, while presently preferred by the inventor should be considered as illustrative of the numerous advantages of the present invention. The skilled artisan will readily realize that numerous modifications, substitutions, and additions may be made to the described embodiments. For example, it is clear that while the embodiments of FIGS. 4–11 show a pair of walking members for each skate, the present invention is not limited to a pair of walking members. It is possible that a single walking member could be provided for each skate or that more than two walking members could be provided for each skate. E.g., it is possible that a pair of walking members could be provided for each wheel or for the forward or back wheels. It is intended that all such modifications, substitutions and additions fall within the scope of the present invention that is best defined by the claims appended hereto.

What is claimed is:

1. A skate, comprising:

an upper defining a heel;

a plurality of wheels supported on the upper;

a clamping member associated with one of the wheels and movable between an engaged position where the clamping member engages the wheel and a disengaged position where the clamping member is disengaged from the wheel; and a pivotable switch positioned adjacent to the heel and movable independently of the upper, operably connected to the clamping member by a cable, and pivotable about a hinge between a first position which pulls the cable around the hinge and moves the clamping member to the engaged position and a second position which allows the clamping member to move to the disengaged position.

2. A skate as claimed in claim 1, wherein the clamping member comprises a plurality of spaced clamping members respectively associated with the plurality of wheels.

3. A skate as claimed in claim 2, wherein each of the spaced clamping members defines a respective pivot point located rearwardly of the wheel associated therewith.

4. A skate as claimed in claim 2, wherein each of the wheels defines an axis of rotation and each of the spaced clamping members defines a pivot point located rearwardly of the axis of rotation of the wheel associated therewith.

5. A skate as claimed in claim 1, wherein the clamping member includes friction pads.

6. A skate as claimed in claim 1, wherein the clamping member is biased away from the wheel.

7. A skate as claimed in claim 1, wherein the pivotable switch is mounted on a switch support.

8. A skate as claimed in claim 7, wherein the pivotable switch and the switch support are respectively constructed an arranged such that the pivotable switch is held securely in place by the switch support when the pivotable switch is in the first position.

9. A skate as claimed in claim 8, wherein the switch support is provided with a relief opening located such that a portion of the pivotable switch will be adjacent to the relief opening when the pivotable switch is in the first position.

10. A skate as claimed in claim 1, wherein the upper is configured to receive a user's leg and the pivotable switch is mounted on the upper such that the pivotable switch can be pivoted without pivoting an adjacent portion of the user's leg.

11. A skate, comprising:

an upper defining a heel;

a plurality of wheels supported on the upper;

a plurality of spaced clamping members respectively associated with the plurality of the wheels and movable between engaged positions where the clamping members engage the wheels and disengaged positions where the clamping members are disengaged from the wheels, each of the clamping members including a pair of arms that pivot about a pivot point located rearwardly of the associated wheel;

a least one cable operably connected to the plurality of spaced clamping members; and a pivotable switch positioned adjacent to the heel and movable independently of the upper, operably connected to the at least one cable, and pivotable between a first position which moves the clamping members to the engaged positions and a second position which allows the clamping members to move to the disengaged positions.

12. A skate as claimed in claim 11, wherein the clamping members include friction pads.

13. A skate as claimed in claim 12, wherein the clamping members are biased away from the wheels.

14. A skate as claimed in claim 12, wherein the pivotable switch pivots about a hinge and pulls the at least one cable around the hinge when the pivotable swithch is moved from the second position to the first position.

15. A skate as claimed in claim 12, wherein the pivotable switch is mounted on a switch support.

16. A skate as claimed in claim 15, wherein the pivotable switch and the switch support are respectively constructed an arranged such that the pivotable switch is held securely in place by the switch support when the pivotable switch is in the first position.

17. A skate as claimed in claim 16, wherein the switch support is provided with a relief opening located such that a portion of the pivotable switch will be adjacent to the relief opening when the pivotable switch is in the first position.

18. A skate as claimed in claim 11, wherein the upper is configured to receive a user's leg and the pivotable switch is mounted on the upper such that the pivotable switch can be pivoted without pivoting an adjacent portion of the user's leg.

19. A skate, comprising:

an upper defining a heel;

a plurality of wheels supported on the upper;

a plurality of spaced clamping members respectively associated with the plurality of the wheels and movable between engaged positions where the clamping members engage the wheels and disengaged positions where the clamping member are disengaged from the wheels, each of the clamping members being biased to its disengaged position and including a pair of arms that pivot about a pivot point located rearwardly of the associated wheel;

a least one cable operably connected to the plurality of spaced clamping members;

a switch support positioned adjacent to the heel; and a pivotable switch mounted on the switch support such that the pivotable switch pivots about an axis, operably connected to the at least one cable, and pivotable between a first position which pulls the at least one cable around the axis and maintains the clamping members in the engaged positions and a second position which allows the clamping members to move to the disengaged positions;

the pivotable switch and the switch support being respectively constructed an arranged such that the pivotable switch is held securely in place by the switch support when the pivotable switch is in the first position.

20. A skate as claimed in claim 19, wherein the switch support is provided with a relief opening located such that a portion of the pivotable switch will be adjacent to the relief opening when the pivotable switch is in the first position.

21. A skate as claimed in claim 19, wherein the upper is configured to receive a user's leg and the pivotable switch and switch support are mounted on the upper such that the pivotable switch can be pivoted without pivoting an adjacent portion of the user's leg.

* * * * *